US005396751A

United States Patent [19]

Chi

[11] Patent Number: 5,396,751

[45] Date of Patent: Mar. 14, 1995

[54] VACUUM EJECTOR FOR HOME USE

[75] Inventor: James Chi, Taipei, Taiwan, Prov. of China

[73] Assignee: Sunfa Plastic Co., Ltd., Taipei, Taiwan, Prov. of China

[21] Appl. No.: 138,099

[22] Filed: Oct. 20, 1993

[51] Int. Cl.[6] ..... B65B 31/04

[52] U.S. Cl. ..... 53/510; 53/88; 53/405

[58] Field of Search ..... 53/510, 79, 88, 105, 53/408, 405, 403, 390, 432; 141/65

[56] References Cited

U.S. PATENT DOCUMENTS

| | | | |
|---|---|---|---|
| 30,440 | 10/1860 | Wildey | 53/405 X |
| 203,796 | 5/1878 | Trezise | 53/88 |
| 220,641 | 10/1879 | Murphin | 53/88 |
| 2,157,624 | 5/1939 | Overmyer | 53/105 X |
| 2,890,810 | 6/1959 | Rohling | 53/405 X |
| 3,452,510 | 7/1969 | Fry | 53/88 |
| 3,672,114 | 6/1972 | Sacks | 53/88 |
| 5,121,590 | 6/1992 | Scanlan | 53/88 X |
| 5,338,166 | 8/1994 | Schultz | 53/88 X |

*Primary Examiner*—James F. Coan

*Attorney, Agent, or Firm*—Jacobson, Price, Holman & Stern

[57] ABSTRACT

A vacuum ejector includes an air ejector connected to a vacuum pump by a tube and controlled by a control switch to withdraw air from a food container. The air ejector includes a cap for covering the food container, a plug fastened to the cap by a screw joint, a valve received within a top recess on the cap and coupled to the plug to control the air passage between the food container and the vacuum pump, and a connector detachably connected between the plug and the tube being connected to the vacuum pump. The vacuum effect can be achieved quickly and conveniently for keeping the food fresh or for other vacuum treatment.

5 Claims, 4 Drawing Sheets

VACUUM EJECTOR FOR HOME USE

BACKGROUND OF THE INVENTION

The present invention relates to vacuum ejectors, especially for home use , which withdraw air from a plastic bag, bottle, can, or any food containers.

In families, food is commonly received in plastic bags or suitable containers and then put in refrigerators. This method can only preserve food from going bad within few days. The most effective way to preserve food from going bad for a period of time is to keep food in a vacuum vessel.

SUMMARY OF THE INVENTION

The present invention has been accomplished under the aforesaid circumstances. It is therefore an object of the present invention to provide a vacuum ejector which is suitable for home use to withdraw air from any food containers. It is another object of the present invention to provide a home use vacuum ejector for use in food preservation, which is easy to operate. According to one embodiment of the invention, the vacuum ejector comprises a vacuum pump, an air ejector connected to the vacuum pump by a tube, and a control switch for controlling the operation of the vacuum pump. The air ejector comprises a cap for covering food container, a plug fastened to the cap by a screw joint, a valve received within a top recess on the cap and coupled to the plug to control the air hole of the cap, and a connector detachably connected between the plug and the tube being connected to the vacuum pump. The valve immediately stop the air hole to keep the food container in a vacuum status as the connector is detached from the tube after air was withdrawn from the food container.

DETAILED DESCRIPTION OF THE PREFERRED EMBODIMENT

Figure 1:
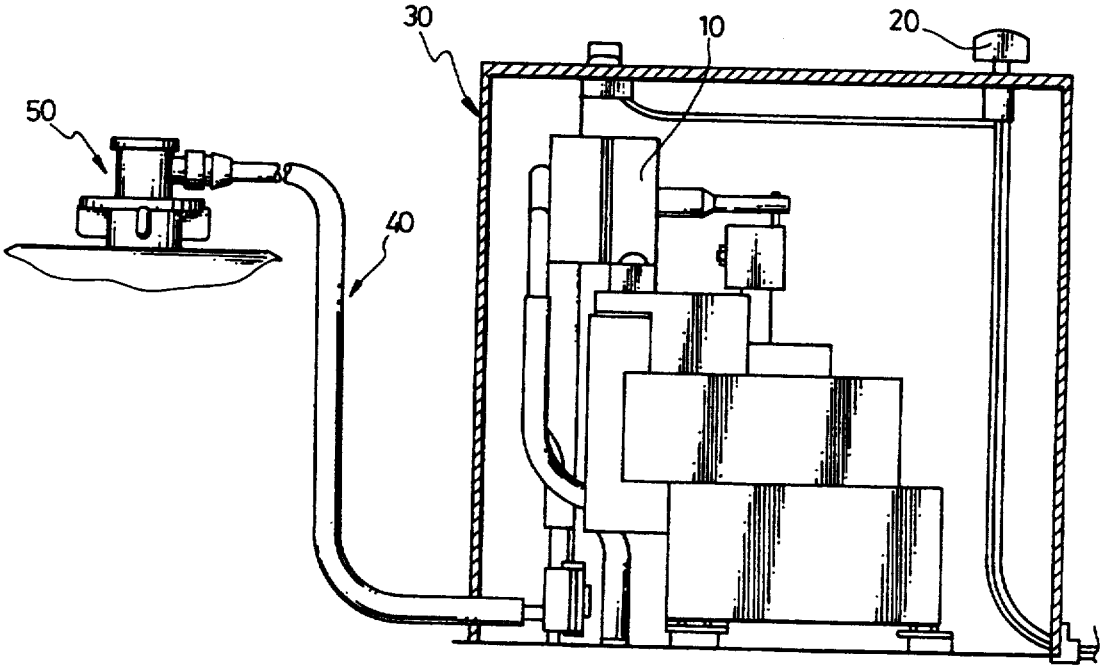
FIG. 1 is a plain view showing a vacuum ejector embodying the present invention.
Figure 2:
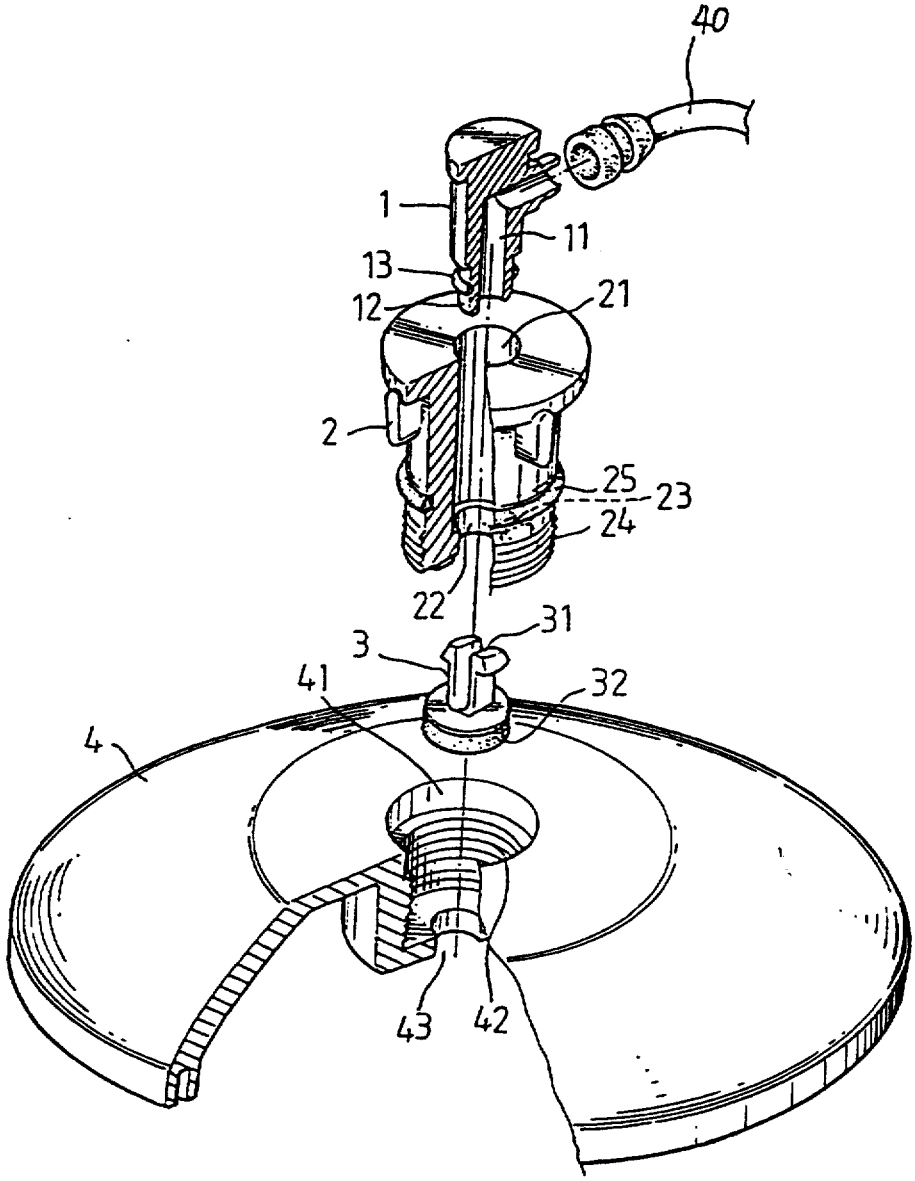
FIG. 2 is an exploded view of the air ejector of the vacuum ejector shown in FIG. 1.

Referring to FIGS. 1 and 2, there is shown a vacuum ejector for use to withdraw air from food containers, generally comprising a housing 30, a vacuum pump 10 fastened within the housing 30, a control switch 20 mounted outside of on the housing 30 for controlling the operation of the vacuum pump 10, an air ejector 50, and a tube 40 connected between the vacuum pump 10 and the air ejector 50. The air ejector 50 comprises a connector 1, a plug 2, a valve 3, and a cap 4.

The connector 1 comprises an air passage 11 including one end connected to the vacuum pump 10 by the tube 40 and the other end being in the shape of a tubular projection 12 fastened with a seal ring 13.

The plug 2 comprises a longitudinal center hole 21 at the top, into which the tubular projection 12 of the connector 1 is inserted with the seal ring 13 sealed between the tubular projection 12 and the periphery wall of center hole 21, a smaller bottom center hole 22 at the bottom aligned with the longitudinal center hole 21, a bottom groove 23 on the bottom edge thereof, a seal ring 25 mounted around the outside wall thereof, and an outer thread 24 near the bottom end thereof.

The valve 3 comprises a hooked spring member 31 raising from a rubber cushion 32 thereof , the diameter of neck of the hooked spring member 31 is smaller than that of the bottom center hole 22, the hooked spring member 31 is inserted into the bottom center hole 22 of the plug 2 and hooked on the peripheral wall of the longitudinal center hole 21. The hooked spring member 31 is made to slide in the bottom center hole 22 of the plug 2 so that the bottom 5 center hole 22 is maintained open for passing air.

The cap 4 comprises a circular top recess 41 in the center , an inner thread 42 around the peripheral wall of the circular top recess 41 and being screwed with the thread 24 of plug 2 and sealed by the seal ring 25 of the plug 2, and an air hole 43 located at the bottom of the circular top recess 41 centrally.

Figure 3:
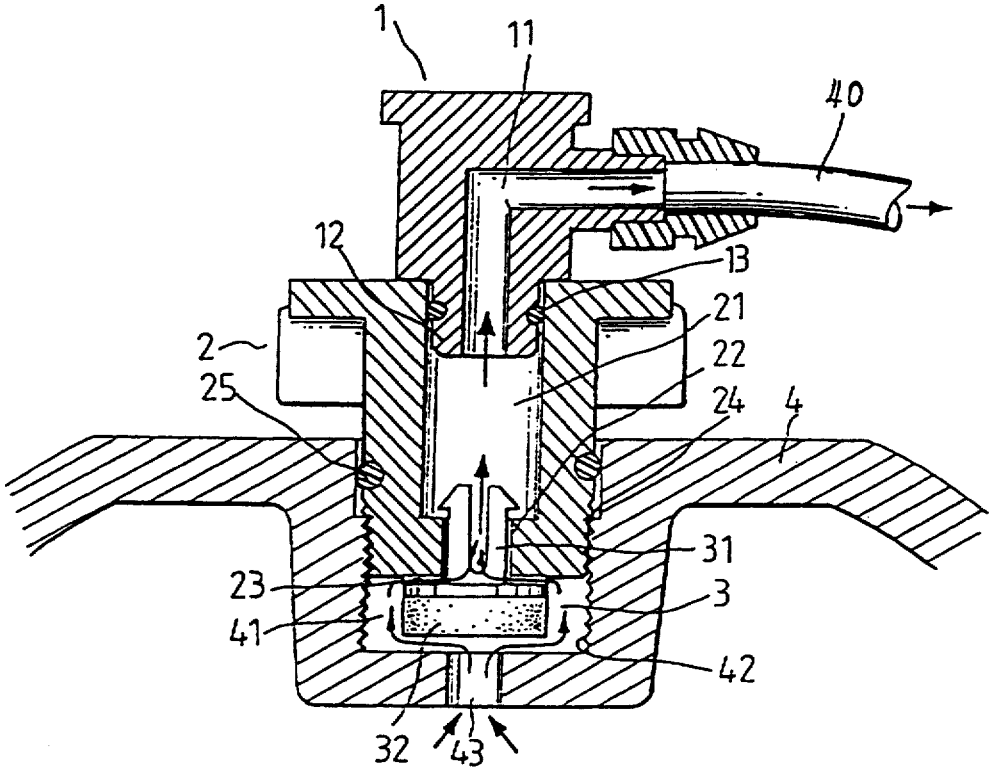
FIG. 3 is a sectional view of the air ejector of FIG. 2, showing air withdrawn from the cap thereof.

The assembly process of the air ejector 50 is outlined hereinafter with reference to FIG. 3, the valve 3 is fastened to the plug 2 by inserting the hooked spring member 31 into the bottom center hole 22, then the plug 2 is fastened to the cap 4 by threading the outer thread 24 into the inner thread 42 with the seal ring 25 sealed between the outside wall of the plug 2 and the peripheral wall of the top recess 41, and then the connector 1 is fastened to the plug 2 by fitting the tubular projection 12 into the longitudinal center hole 21 with the seal ring 13 sealed between the outside wall of tile tubular projection 12 and the peripheral wall of the longitudinal center hole 21. When in use, the connector 1 is fastened to the vacuum pump 10 by the tube 40. As the vacuum pump 10 is started by means of the control of the control switch 20, the valve 3 is moved upwards by the suction effect of the vacuum pump 10 to open the air hole 43, and therefore air is withdrawn from the container through the air hole 43, the bottom groove 23 and center hole 21 of plug 2 and the connector 1 to the vaccum pump.

Figure 4:
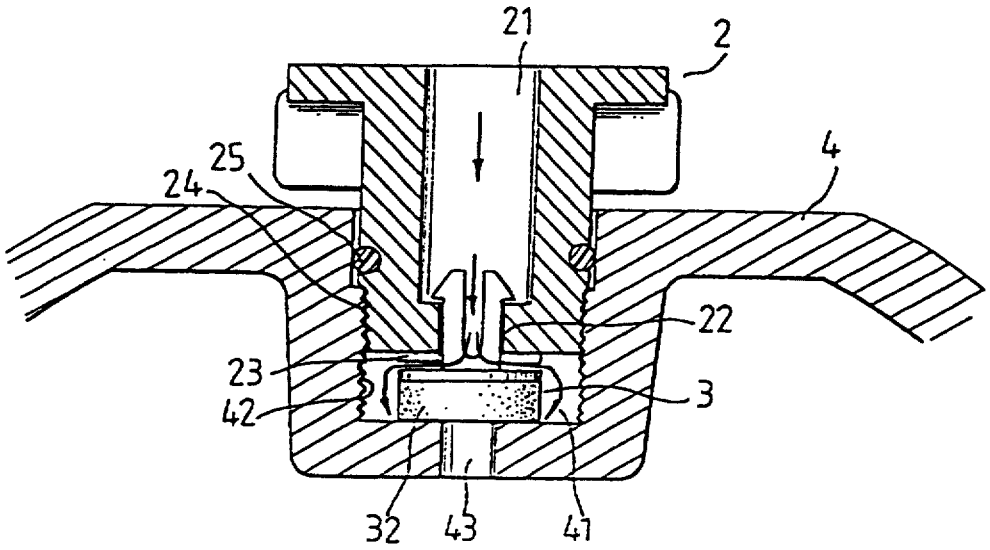
FIG. 4 is similar to FIG. 3 but showing the air hole on the cap stopped by the valve.

Referring to FIG. 4, as air has been withdrawn from the container (the cap 4), the connector 1 is detached from the plug 2. As the connector 1 is removed from the plug 2, a big air pressure difference exists between the opposite sides of the cap 4, and therefore the valve 3 immediately falls down to stop the air hole 43. Therefore the container covered by the cap 4 is maintained in a vacuum condition, and the food contained in the container can be kept fresh for a long time.

Figure 5:
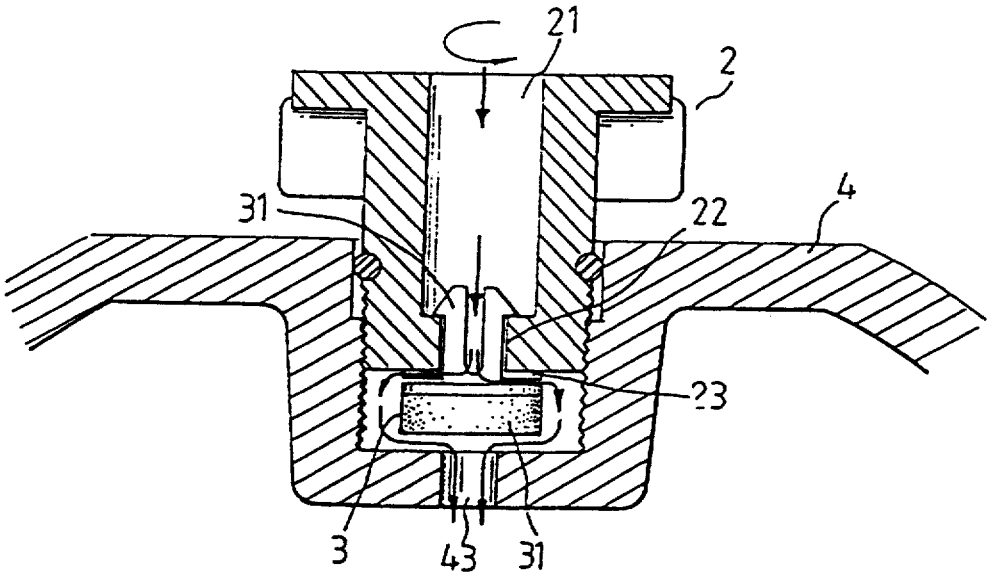
FIG. 5 is another sectional view of the air ejector, showing the valve released from the air hole of the cap.

Referring to FIG. 5, turning the plug 2 in the reversed direction causes the plug 2 to carry the valve 3 tip from the air hole 43 for permitting outside air to enter the container, and therefore the container is soon released from the vacuum status.

As indicated, the present invention provides a home use vacuum ejector which is practical for use to withdraw air from food containers so that foods can be maintained fresh for a long time.

Although only one embodiment of the present invention has been shown and described, it will be understood that various modifications and changes could be made without deviating from the spirit and scope of the invention.

What is claimed is:

1. A vacuum ejector for withdrawing air from food containers, comprising a housing, a vacuum pump fastened within said housing, a control switch mounted on the outside of said housing for controlling the operation of said vacuum pump, an air ejector, and a tube connected between said vacuum pump and said air ejector, said air ejector comprising a cap covered on the food container to be vacuumized, said cap including an air hole through the center of a top recess in said cap, a connector, a plug including one end connected to said tube by said connector and the other end fastened to the top recess of said cap by a screw joint, said plug including an air passage providing communication between said air hole and said tube with said connector, and a valve movably connected to said plug and received within the top recess of said cap and forced by outside air pressure to close and seal said air hole to maintain said food container in a vacuum condition after said connector is detached from said tube.

2. The vacuum ejector of claim 1 wherein said connector comprises an air passage including one end connected to said tube and the other end, being the shape of tubular projection, fitted into the air passage of said plug and sealed by a seal ring to provide communication between said tube and the air passage of said plug.

3. The vacuum ejector of claim 1 wherein said plug comprises an outer thread threaded into an inner thread on said top recess of said cap and sealed by a seal ring, and a bottom groove intersecting with a bottom center hole thereof, the bottom center hole of said plug including a lower portion of smaller diameter.

4. The vacuum ejector of claim 1 wherein said valve comprises a rubber cushion, and a hooked spring member raising from said rubber cushion at the top, the diameter of neck of the hooked spring member is smaller than the said bottom center hole, said hooked spring member being inserted into the bottom center hole of said plug from the bottom and moved vertically and freely to close or open said air hole of said cap.

5. The vacuum ejector of claim 1 wherein said cap comprises a circular top recess in the center, an inner thread around the peripheral wall of the circular top recess and being threadably engaged with the plug and sealed by the seal ring of the plug, and an air hole through the bottom of the circular top recess in the center.

* * * * *